US005791323A

United States Patent [19]

Dunlap

[11] Patent Number: 5,791,323

[45] Date of Patent: Aug. 11, 1998

[54] PULLEY WITH POSITIONABLE SPOOL FOR A COMPOUND ARCHERY BOW

[76] Inventor: Patrick J. Dunlap, 13290 Table Rock Rd., Central Point, Oreg. 97502

[21] Appl. No.: 754,384

[22] Filed: Nov. 21, 1996

[51] Int. Cl.[6] ..... F41B 5/10

[52] U.S. Cl. ..... 124/25.6; 124/900

[58] Field of Search ..... 124/25.6, 900

[56] References Cited

U.S. PATENT DOCUMENTS 4,060,066 11/1977 Kudlacek ..... 124/25.6
4,515,142 5/1985 Nurney ..... 124/25.6
4,774,927 10/1988 Larson ..... 124/25.6
4,926,833 5/1990 Darlington ..... 124/25.6 X
4,995,373 2/1991 Mussack ..... 124/25.6

*Primary Examiner*—John A. Ricci
*Attorney, Agent, or Firm*—James D. Givnan, Jr.

[57] ABSTRACT

A pulley assembly for a compound bow is provided with a take-up of spool configuration to receive a segment of a tensionable bow member wound thereabout. The take-up is engageable with the pulley proper member in a manner preventing relative movement between take-up and pulley assembly. To alter length of a tensionable member of the bow, the take-up is positionable about an axis parallel to an axis of the pulley assembly and lockable thereto. Modified forms of the take-up disclose various locking arrangements.

11 Claims, 2 Drawing Sheets

PULLEY WITH POSITIONABLE SPOOL FOR A COMPOUND ARCHERY BOW

BACKGROUND OF THE INVENTION

The present invention pertains generally to compound archery bows which utilize tensioned cables and bowstrings carried by pulleys at the bow ends.

Bowstrings, as used in current compound bows, are of synthetic material and are subject to creep or stretching after a period of use resulting in a number of problems, any one of which adversely affects bow accuracy. For example, the bending rates of bow limbs may be altered, the rotation of the bow pulleys or wheels may be out of synchronization, the nock position may be dislocated. While some manufacturers have attempted to solve the bowstring elongation problem, their efforts to date have provided for only very limited bowstring adjustment, perhaps an inch or so take up. A remaining solution is the costly purchase and installation of a new bowstring which will subsequently stretch as a result of forces applied thereto. Extreme temperatures and humidity also adversely affect bowstrings.

Another bowstring problem occurs when an archer desires to vary the draw length of a bow which typically requires the purchase and installation of a new bowstring. The capability of existing bow mounted pulleys or wheels to alter bowstring length is very limited and is in relatively large increments which prevents precise tensioning of the bowstring during installation.

In the prior art, U.S. Pat. No. 4,926,832 discloses pulleys 42 in place on a compound archery bow with each pulley provided with multiple knobs for attachment thereto of a tension cable end with an additional set of knobs for selective attachment thereto of the ends of a bowstring. Such an arrangement permits only modest changes in the effective length of the tensioned members.

SUMMARY OF THE PRESENT INVENTION

The present invention is embodied within a compound bow mounted pulley having an adjustable take-up feature capable of being indexed about an axis and locked in place to permit precise adjustment of a tensionable bow member.

The present pulley assembly is equipped with or includes a rotatable and lockable member having multiple tracks on which tensionable bow members are entrained. Typically on compound bows rotatable members, termed pulleys, cams, cam wheels, etc., are mounted in an eccentric manner to lessen the force required to hold a drawn arrow. In the present pulley assembly a take-up spool is mounted in a manner permitting periodic, arcuate positioning, relative the pulley proper, for altering the effective length of a bowstring and/or a cable of the bow. While shown and described as being utilized to vary bowstring length, it will be understood that the present invention may also be utilized to adjust a bow cable. Provision is made in the present pulley assembly for indexing of a take-up spool and subsequent locking of same to a rotatable bow member in a convenient manner.

Important objectives of the present invention include the provision of a take-up spool in place on a compound bow pulley for the purpose of permitting a tensioned member of the compound bow to be lengthwise altered; the provision of a take-up spool carried by a compound bow pulley permitting the tensionable member of the bow to be adjusted in fine increments to dispense with the necessity of changing the tensionable member; the provision of a take-up spool in the form of a spool which may be indexed about an axis to reduce or increase the length of a tensionable bow member; the provision of a take-up spool in combination with a pulley for a compound bow to provide incremental indexing means enabling precise adjustment of a tensionable bow member; the provision of a take-up which permits binding securement of a bowstring or cable end segment without formation of a loop on the bowstring or the attachment of a lug to a cable end.

DETAILED DESCRIPTION OF THE PREFERRED EMBODIMENTS

Figure 1:
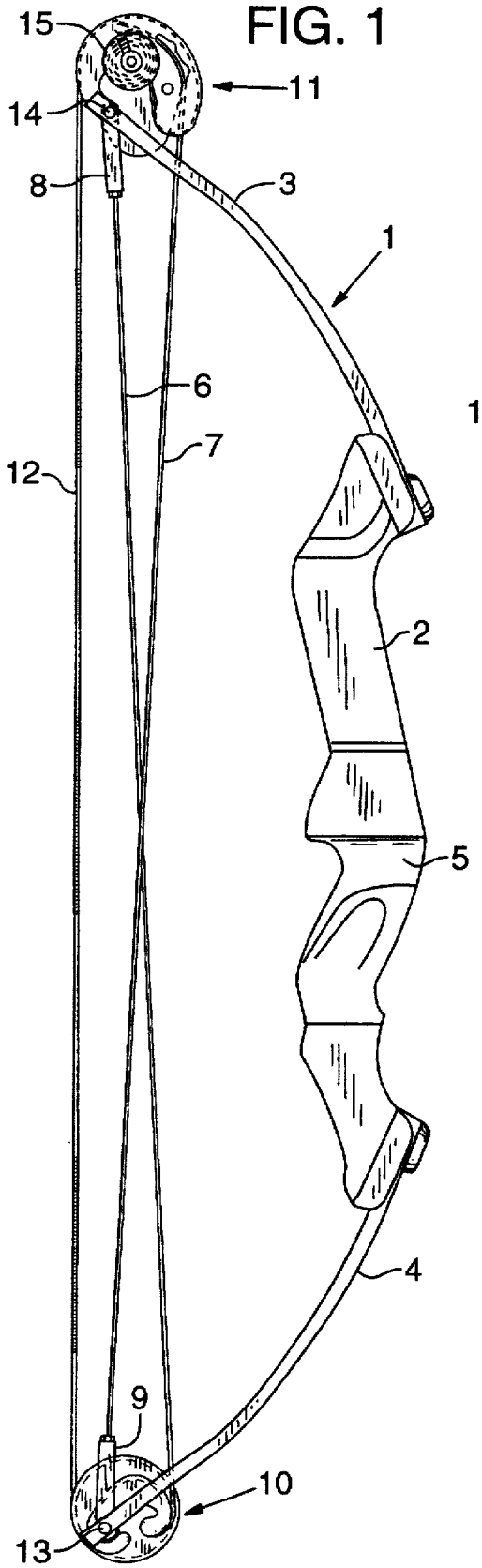
FIG. 1 is a side elevational view of a compound bow.
Figure 2:
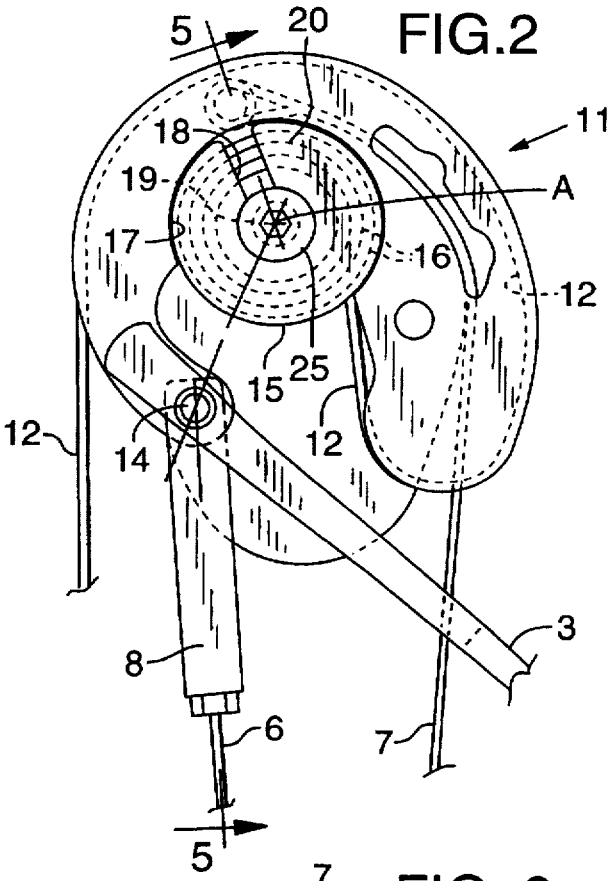
FIG. 2 is an enlarged side elevational view of a pulley assembly of the bow shown in FIG. 1.
Figure 3:
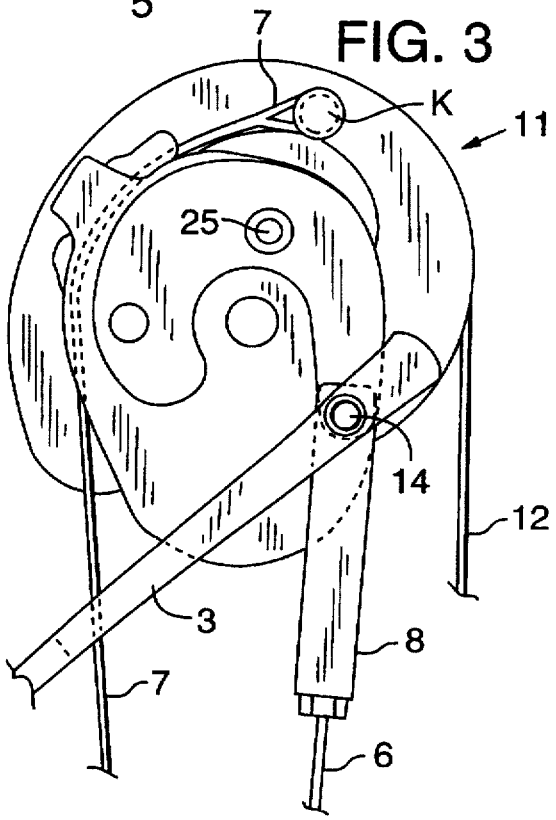
FIG. 3 is a side elevational view of the unseen side of the pulley assembly shown in FIG. 2.

With continuing attention to the drawings, wherein applied reference numerals indicate parts similarly hereinafter identified, the reference numeral 1 indicates generally a compound archery bow.

The bow includes a riser 2 from which project upper and lower limbs 3 and 4. A hand grip is indicated at 5. Tensionable bow members of the bow include cables 6 and 7 which are further tensioned by displacement of a bowstring at 12 during drawing of same. Typical rigging of a compound bow includes the ends of cables 6 and 7 being secured to devises 8, 9 with the remaining end of each cable 6 and 7 being entrained and secured thereto about a portion of a pulley assembly of the type indicated generally at 10. During drawing of a bow, pulley assemblies are partially rotated about pivot pins such as at 13, 14 carried by the bow limbs with the effective length or run of each cable being reduced to impart inwardly directed forces to each limb end. The foregoing description of cable rigging is intended to be typical as it is understood that variations of such rigging may be found in the wide variety of makes and models of compound bows including some having a bowstring as an extension of a cable. While the following description of the invention is in conjunction with a single pulley assembly indicated generally at 11, both pulleys of a bow could utilize the present invention to increase the range of lengthwise adjustment of a tensionable bow member. A knob K on pulley 11 attaches the looped end of cable 7.

Figure 6:
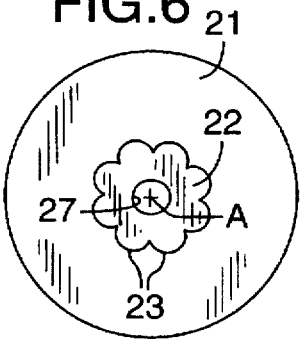
FIG. 6 is an elevational view of the take-up shown in FIG. 4.

A take-up spool 15 is carried by pulley assembly 11 and is shown having wraps 16 of bowstring 12 thereon. The take-up spool is received within an inset area 17 of pulley assembly 11. A radially directed opening 18 in a sidewall 20 of the spool facilitates attachment of tensionable member 12 to the take-up as by wrapping thereabout. As shown in FIG. 6, the remaining sidewall at 21 of the take-up or spool may be continuous.

Figure 4:
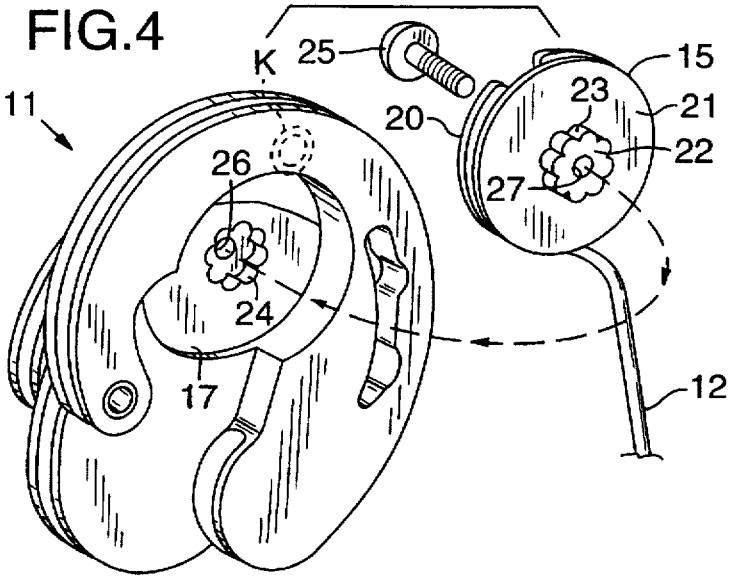
FIG. 4 is a perspective exploded view of the pulley shown in FIGS. 2 and 3 with a take-up spool shown detached from the pulley assembly.
Figure 5:
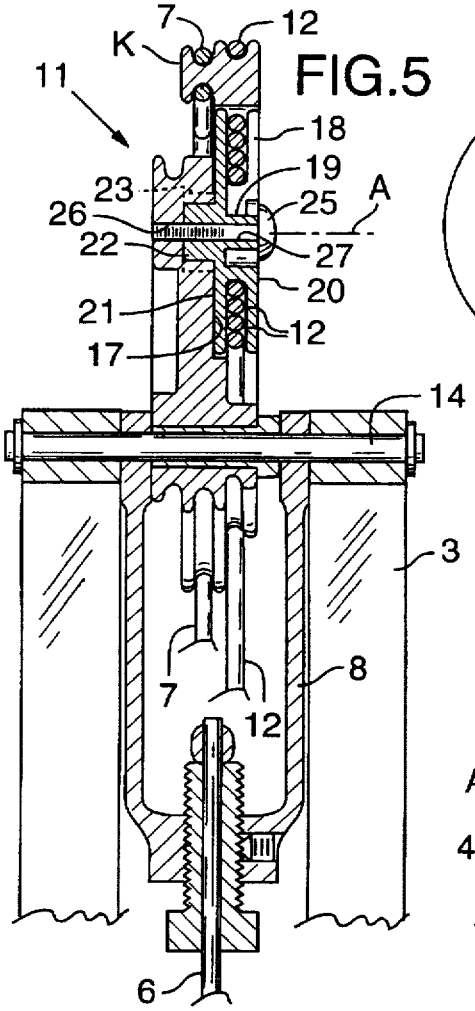
FIG. 5 is a vertical sectional view taken along line 5—5 of FIG. 2.

For preventing rotation of take-up spool 15 relative to the pulley, locking means are provided which, in addition to locking the take-up spool in place, permits indexing of the take-up spool in increments fully about an axis A in parallel with the axis of a pulley pivot pin 14, in fine increments, for take up or letting out of member 12. A preferred locking means is disclosed in FIGS. 4, 5 and 6 wherein sidewall 21 of take-up 15 includes a member 22 projecting axially from wall 21 and provided with an irregular perimeter 23 for mating with a corresponding edge 24 formed on pulley 11. One suitable irregular perimeter 23 is that formed by a series of scallops or arcuate walls which permit incremental take-up spool positioning about axis A and re-engagement with pulley edge 24. A fastener 25 extends axially through a bore 27 for engagement within a threaded opening 26 of the pulley. An internally threaded sleeve may be utilized in the pulley to receive fastener 25 threads.

Figure 7:
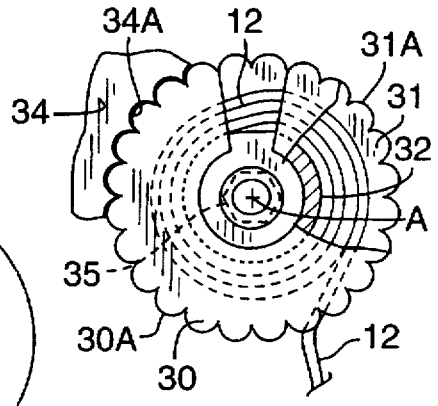
FIG. 7 is an elevational view of a modified form of take-up shown with a fragment of a supporting pulley assembly.

A modified take-up spool is shown in FIG. 7 which includes sidewalls 30 and 31 with perimeters at 30A and 31A of irregular configuration to constitute locking members engageable with a pulley 34 formed with a correspondingly shaped inner edge 34A. The locking members 30A and 31A engage pulley edge 34A to prevent take-up spool rotation relative the pulley and permit dispensing with the axial projection of the type shown at 22 in FIG. 4. Accordingly, a bow pulley may be of lesser cross-section or depth. A fastener 35 terminates in threaded engagement with a threaded bore formed in the pulley wall of reduced thickness.

Figure 9:
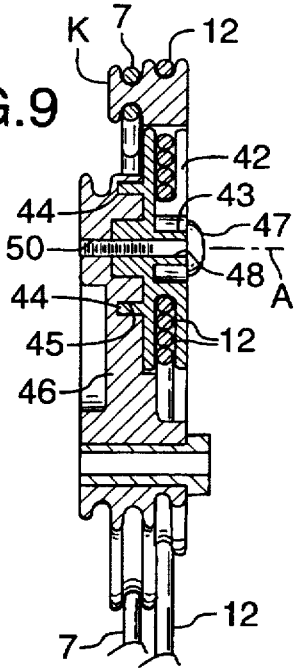
FIG. 9 is a vertical sectional view similar to FIG. 5 but showing the take-up shown in FIG. 8 in place on the pulley assembly.
Figure 8:
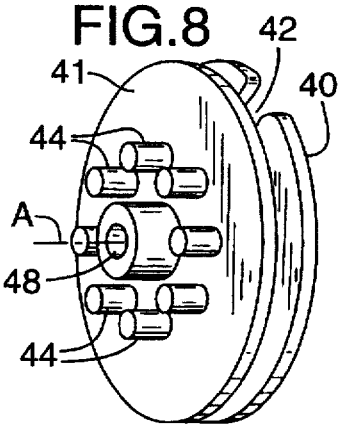
FIG. 8 is a perspective view of one side of a modified take-up.

FIGS. 8 and 9 disclose still another modified take-up spool having sidewalls 40 and 41 with the former having a radially extending slot 42 permitting attachment of a bowstring end about a hub 43 in FIG. 9 if desired. Locking members 44 are embodied in a circular array of pins uniformly spaced from one another and from an axis A of the take-up spool for selective engagement with corresponding sockets 45 formed within a pulley 46. A fastener 47 extends through a bore 48 in the take-up for threaded engagement with a threaded pulley bore 50.

Bowstring adjustment entails loosening of fastener 47, at least partial unseating of the take-up to disengage the locking means, incremental rotation of the take-up spool to reduce or increase the effective length of the bowstring and reseating of the take-up spool in the pulley. During such bowstring adjustment the tensioning of the bowstring will be reduced as by temporarily flexing of the bow limbs.

It will be understood that the locking means, while shown as having arcuate or curved surfaces in some forms of the present invention, may be of other irregular configuration including a toothlike edge similar to gear teeth for adjustable engagement with a corresponding edge of a pulley.

The take-up spool permits securement of an end segment of a tensionable member by wrapping same about the take-up spool with the wraps binding one another against slipping about the take-up. Accordingly costly loop forming of a bowstring end is avoided as well as the affixing of a lug to a cable end for securement purposes.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A pulley for a compound archery bow and including, a rotatable member having multiple tracks on which tensionable bow members including a bowstring are entrained, means for coupling said member to the bow for movement about a first axis, a bowstring take-up spool carried by said member and rotatably positionable in increments relative said rotatable member and about a second axis parallel to said first axis and on which a bowstring end segment of selected length may be wound to vary the effective length of the bowstring, and means attaching said take-up spool to said rotatable member, and said take-up spool and said rotatable member having interengageable locking means for retention of said take-up spool against movement relative said rotatable member.

2. The pulley assembly claimed in claim 1 wherein said locking means includes an axially projecting member having an irregular edge.

3. The pulley assembly claimed in claim 2 wherein said irregular edge is defined by arcuate surfaces.

4. The pulley assembly claimed in claim 1 wherein said take-up spool includes a sidewall having an irregular outer edge, said rotatable member having a corresponding edge for engagement with said irregular outer edge.

5. The pulley assembly claimed in claim 1 wherein said locking means includes axially directed projections on said take-up spool radially offset from said second axis and spaced in uniform increments thereabout.

6. The pulley assembly claimed in claim 5 wherein said projections are pins in place on said take-up spool.

7. In combination, a pulley for a compound archery bow having a tensionable member, a take-up spool on said pulley on which an end segment of predetermined length of the tensionable member is wound, and locking means on said pulley and said take-up spool engageable to prevent relative rotational movement between said take-up spool and said pulley, said locking means including an axial projection having an irregular outer edge.

8. The combination claimed in claim 7 wherein said irregular edge is defined by arcuate surfaces.

9. In combination, a pulley for a compound archery bow having a tensionable member, a take-up spool on said pulley on which an end segment of the tensionable member may be installed, said take-up spool including a sidewall, locking means on said pulley and said take-up spool engageable to prevent relative rotational movement between said take-up spool and said pulley, said locking means including an irregular outer edge on said sidewall, said pulley having a corresponding inner edge for locked engagement with said irregular outer edge.

10. In combination, a pulley for a compound archery bow having a tensionable member, a take-up spool on said pulley on which an end segment of the tensionable member may be installed, said take-up spool including a sidewall, locking means on said pulley and said take-up spool engageable to prevent relative rotational movement between said take-up spool and said pulley, said locking means including a circular array of pins.

11. The combination claimed in claim 10 wherein said pins are in place on said take-up spool.

* * * * *